US011732536B2

(12) United States Patent
Provost

(10) Patent No.: US 11,732,536 B2
(45) Date of Patent: Aug. 22, 2023

(54) SETTING AND RETRIEVAL MECHANISM

(71) Applicant: Wilfred Provost, Tomball, TX (US)

(72) Inventor: Wilfred Provost, Tomball, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 168 days.

(21) Appl. No.: 17/205,318

(22) Filed: Mar. 18, 2021

(65) Prior Publication Data

US 2022/0298875 A1 Sep. 22, 2022

(51) Int. Cl.
*E21B 23/00* (2006.01)
*E21B 23/06* (2006.01)

(52) U.S. Cl.
CPC ..... *E21B 23/00* (2013.01); *E21B 23/06* (2013.01)

(58) Field of Classification Search
CPC ..... E21B 23/00; E21B 23/06
See application file for complete search history.

(56) References Cited

U.S. PATENT DOCUMENTS 5,727,632 A 3/1998 Richards
5,941,306 A 8/1999 Quinn
9,528,342 B2 12/2016 Xu et al.
2010/0025047 A1* 2/2010 Sokol ..... E21B 23/02 166/99
2012/0012303 A1* 1/2012 Xu ..... E21B 23/00 166/88.2
2016/0230489 A1* 8/2016 Evans ..... E21B 31/107
2019/0323306 A1 10/2019 Wubben et al.

FOREIGN PATENT DOCUMENTS

EP 2518260 A1 10/2012

OTHER PUBLICATIONS

International Search Report and Written Opinion; PCT/US2022/071163; Korean Intellectual Property Office; dated Jun. 16, 2022; 10 pages.
Superior Energy Services: "Completion Tools Catalog: Section 4: Sealbore Packers and Accessories"; Completion Tools Catalog 2019; 3 pages.

* cited by examiner

*Primary Examiner* — George S Gray
(74) *Attorney, Agent, or Firm* — Cantor Colburn LLP

(57) ABSTRACT

A setting and retrieval mechanism for a well tool including a mandrel, a body lock ring disposed on the mandrel, a body lock ring engagement member engaged and disengagable with the body lock ring, and a setting load and retrieval sleeve disposed on the mandrel and having an engagement member support region and an engagement member release region. A method for retrieving a downhole tool including moving a setting and retrieval sleeve to position an engagement member release region of the setting and retrieval tool to allow disengagement of an engagement member with a body lock ring, placing a tensile force on the setting and retrieval sleeve, disengaging the engagement sleeve from the body lock ring under the impetus of the tensile force on the setting and retrieval sleeve, and releasing captured energy in the downhole tool by the disengaging and the tensile force on the setting and retrieval sleeve.

19 Claims, 8 Drawing Sheets

SETTING AND RETRIEVAL MECHANISM

BACKGROUND

In the resource recovery industry tools are run into a borehole and set there fore various purposes. Some of these tools are permanently set but some are intended to be retrievable. Retrievable tools include apparatus to relieve tension on one or another of the components of a particular tool so that trapped energy in the tool from the setting process can be released, thereby facilitating the retrieval. While in the art there are retrieval mechanisms that work for this purpose, there are also difficulties related to access to the apparatus to relieve tension due to other tools being in the way or debris collecting on the tool obscuring retrieval apparatus. The art will benefit from additional retrieval mechanisms that provide reliability.

SUMMARY

An embodiment of a setting and retrieval mechanism for a well tool including a mandrel, a body lock ring disposed on the mandrel, a body lock ring engager/engagement member engaged and disengagable with the body lock ring, and a setting load and retrieval sleeve disposed on the mandrel and having an engager/engagement member support region and an engager/engagement member release region.

A method for retrieving a downhole tool including moving a setting and retrieval sleeve to position an engager/engagement member release region of the setting and retrieval tool to allow disengagement of an engager/engagement member with a body lock ring, placing a tensile force on the setting and retrieval sleeve, disengaging the engagement sleeve from the body lock ring under the impetus of the tensile force on the setting and retrieval sleeve, and releasing captured energy in the downhole tool by the disengaging and the tensile force on the setting and retrieval sleeve.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
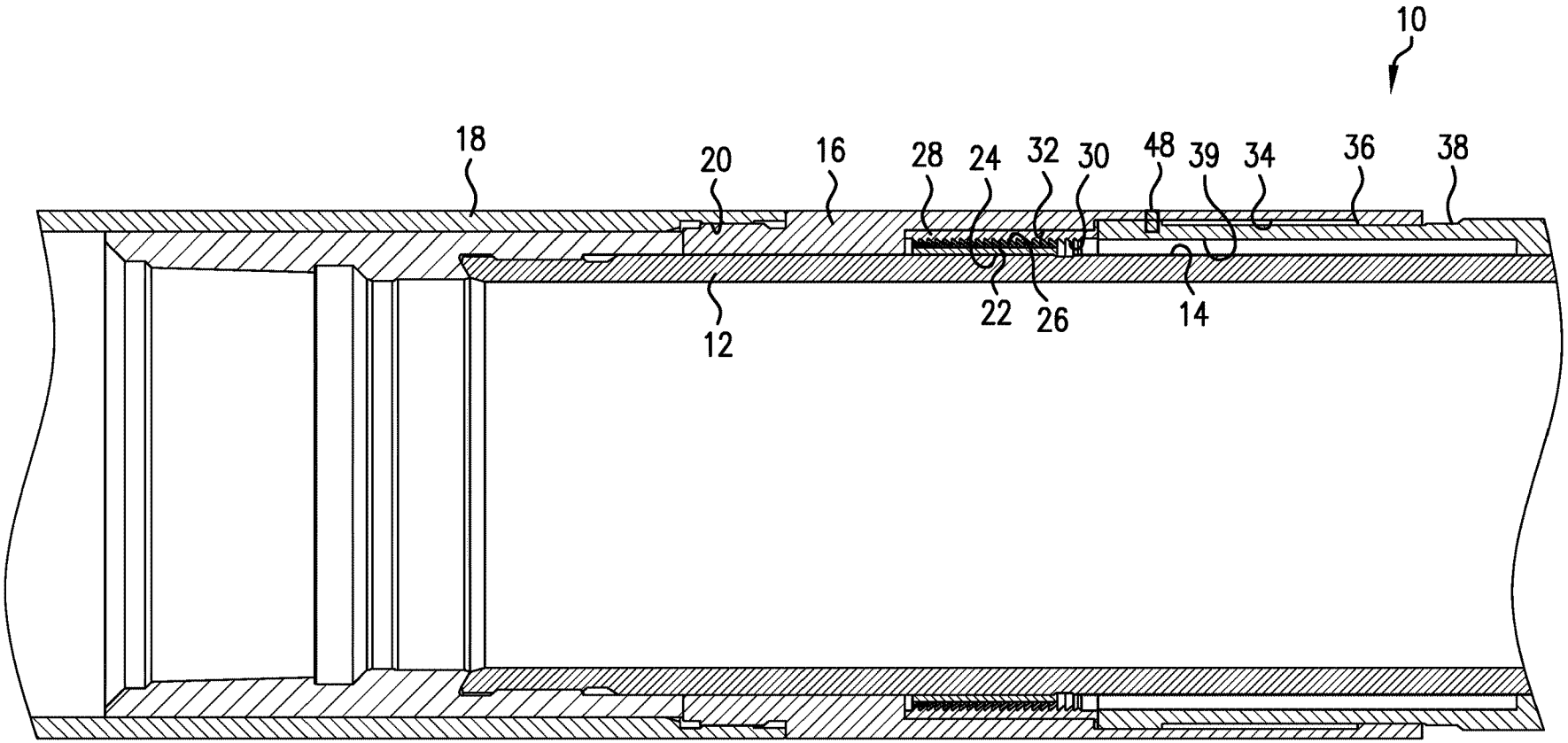
FIG. 1 is a cross section view of a tool have a retrieval mechanism as disclosed herein prior to setting of the tool.

Referring to FIGS. 1-4, a first embodiment of a setting and retrieval mechanism 10 is illustrated. In FIG. 1, the mechanism 10 is in a run in condition. The mechanism includes a mandrel 12 having wickers 14 thereon. A setting and retrieval sleeve 16 is disposed radially outwardly of the mandrel 12 and slidable thereon. The sleeve 16 is operably connected to an actuator sleeve 18 that allows input from the actuator sleeve 18 in the form of pushing downhole or pulling uphole to impart the same motion on the setting and retrieval sleeve 16. In an embodiment, this occurs through a thread 20. Adjacent the setting and retrieval sleeve 16 are a body lock ring 22, having wickers 24 at an inside surface thereof and wickers 26 at an outside surface thereof. Also adjacent the sleeve 16 is an engager/engagement member 28, having inside surface wickers 30 engageable with outside surface wickers 26 of body lock ring 22. The setting and retrieval sleeve 16 defines an engager/engagement member support region 32 and an engager/engagement member release region 34. The sleeve 16 also includes a retrieval hook 36. Finally illustrated is a tool interface 38 that transmits both a compressive load to the tool during setting and a tensile load to the tool during retrieval.

Figure 2:
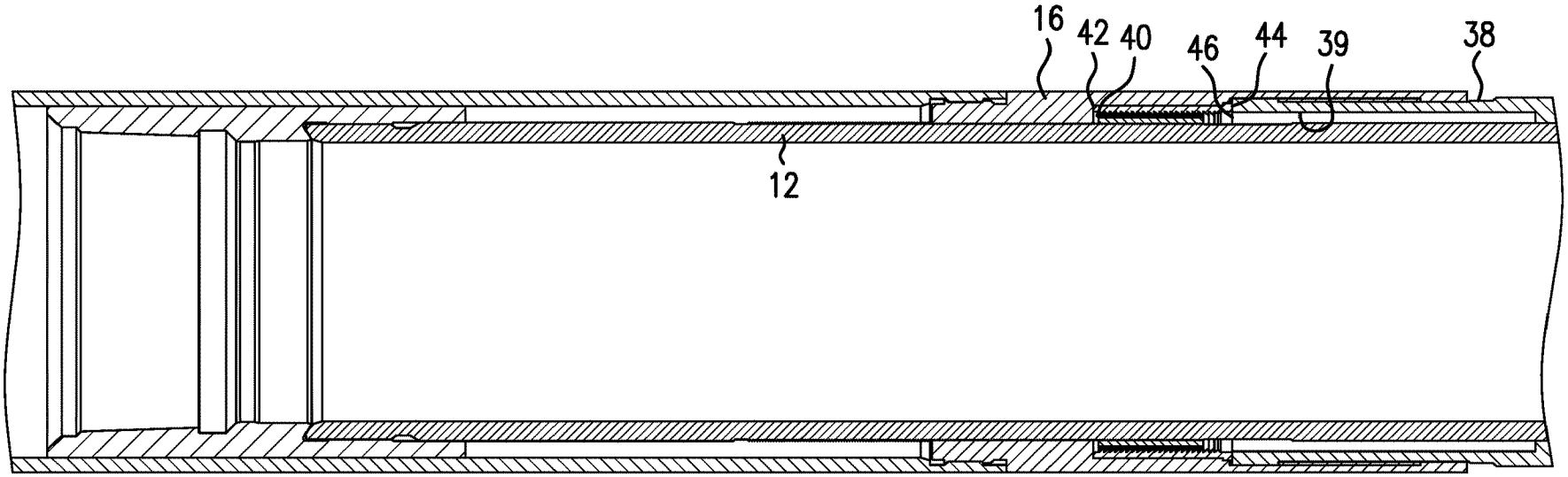
FIG. 2 is the mechanism in the set position.

Referring to FIG. 2, the setting and retrieval mechanism 10 is in the set position. It should be noted that the setting and retrieval sleeve 16 has shifted relative to the mandrel 12. A load from uphole is transmitted through sleeve 18 into sleeve 16 and then through shoulder 40 of sleeve 16 into uphole end 42 of engager/engagement member 28, through member 28 to downhole end 44 into surface 46 of tool interface 38. All of these components move in the downhole direction together. The body lock ring (BLR) 22 is engaged with engager/engagement member 28 as well, so the body lock ring 22 also moves downhole relative to the mandrel 12. BLR 22 is segmented or a C-ring or similar so that it may ratchet along the wickers 14 of the mandrel 12 as it moves in the downhole direction (right of figure). The wickers 24 and wickers 14 are profiled to allow relative movement only of the BLR 22 moving downhole relative to the mandrel 12. Wickers 24 and 14 when engaged with each other prevent movement in the opposite direction. Accordingly, with the mechanism 10 in the position shown in FIG. 2, energy imparted to the attached tool (not shown) through the sleeve 18 is held there indefinitely unless another action from uphole is taken.

Figure 3:
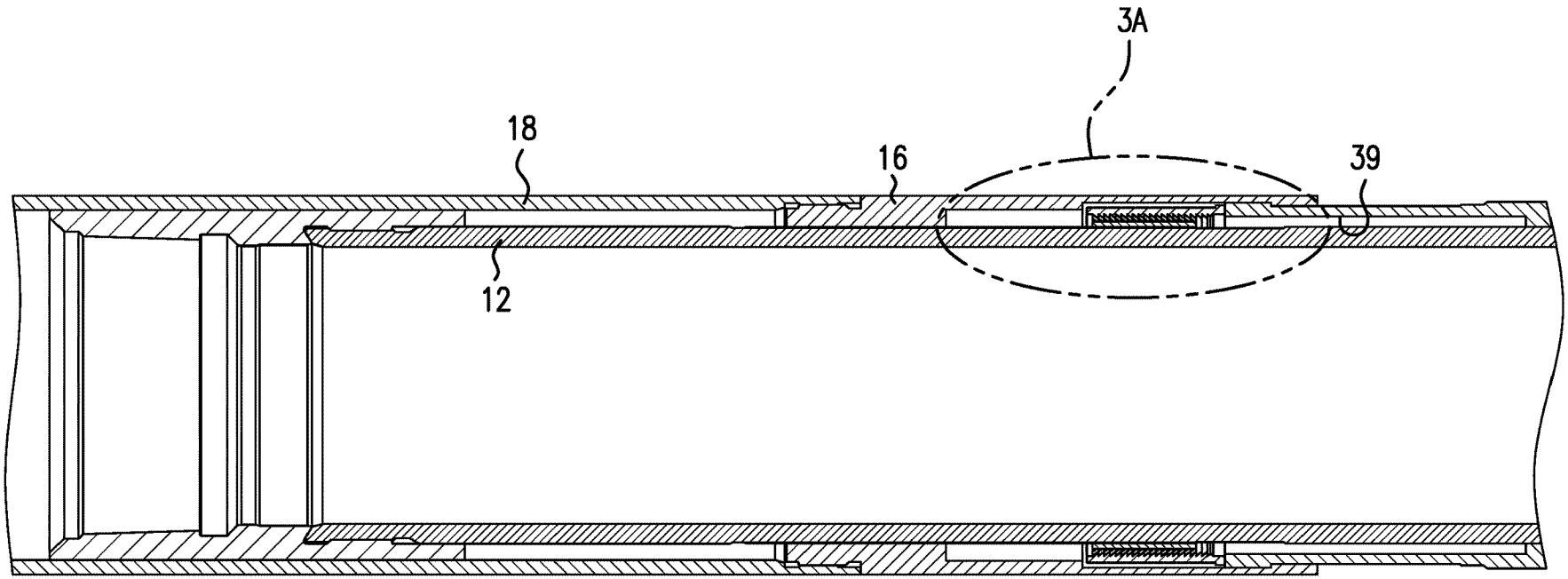
FIG. 3 is the mechanism in the release position.
Figure 3A:
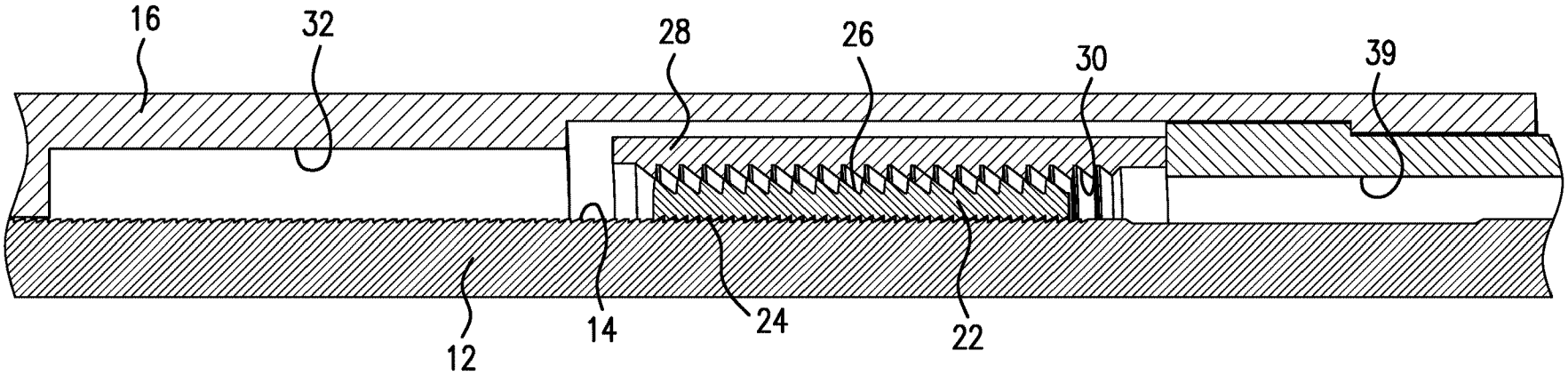
FIG. 3*a* is an enlarged portion of FIG. 3 to elucidate details.
Figure 4:
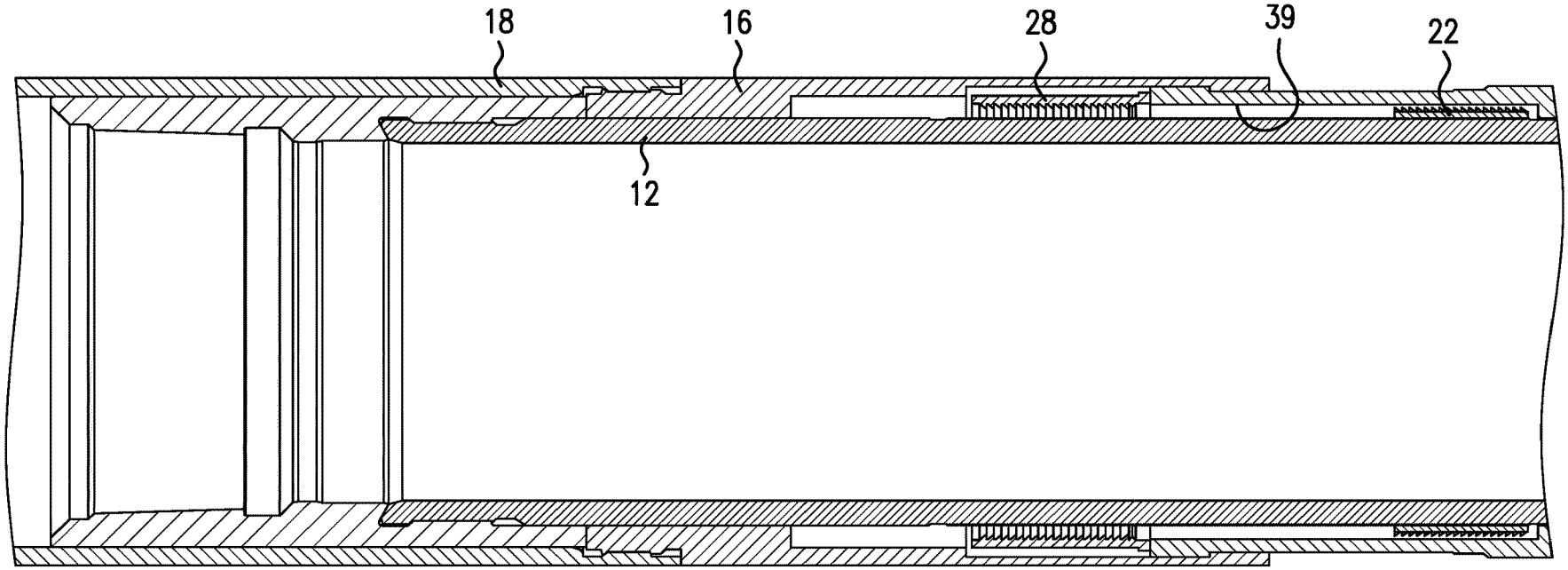
FIG. 4 is the mechanism in the retrieve position.

Referring to FIG. 3, the alluded to action from uphole has been taken and the mechanism 10 is illustrated immediately after that action was taken. Specifically, the action taken is a tensile load placed upon the sleeve 18, which pulls the sleeve 16 in the uphole direction sliding engager/engagement member support region 32 out of alignment with the engagement member 28 and instead aligning the engager/engagement member release region 34 with the engager/engagement member 28. With this alignment, there is a radial space for the engager/engagement member 28 to be driven into. Ratcheting the engager/engagement member 28 over the BLR 22 allows the BLR 22 to stay in the set position while allowing the rest of the mechanism to be retrieved thereby removing the energy held in the attached downhole tool. Specifically, the wickers 14 on the mandrel 12 are engaged at a particular location along wickers 14 with the BLR 22 in the set position. This does not change when the tool is retrieved. Rather, the release of the engager/engagement member 28 from the BLR 22 is what allows components to move. Reference is now made to FIG. 3*a*, which is an enlarged view of the circumscribed area 3*a*-3*a* in FIG. 3. This view makes what happens during retrieval easier to understand. Specifically, as noted, the wickers 24 of BLR 22 remain engaged with the wickers 14 on the mandrel 12 in the as set position. Because the sleeve 16 has moved however, which unaligns engager/engagement member support region 32 with the engager/engagement member 28 and instead aligns engager/engagement member release region 34 with the engager/engagement member 28, that member is free to be displaced radially outwardly and ratchet across the fixed position BLR 22. The engager/engagement member 28 may be segmented or may be a C-ring or similar so that radially outward expansion is possible. It should also be noted that the wickers 26 on the BLR 22 and the wickers 30 on the engager/engagement member 28 are angled such that the radially outward displacement of the engager/engagement member 28 with relative axial movement between the engager/engagement member 28 and BLR 22 is enabled. It will be appreciated that the wickers 24 and 26 of the BLR 22 are angled in the same direction but the movements appear in the opposite direction. This is because the first movement of the BLR 22 relative to the mandrel 12 is to the right in the Figure (BLR 22 moves to right while Mandrel 12 is stationary, for example) and the movement of the sleeve 16 is to the left (BLR 22 is stationary and sleeve 16 moves to left, for example). The apparent direction of ratcheting movement being opposite is actually a function of which component is moving relative to which component. In an embodiment, the angle is 60 degrees or less measured from a longitudinal axis of the BLR 22. Because of the ability of the engager/engagement member 28 ratcheting over the BLR, the energy that was held within the mechanism to set the downhole tool is released. Further movement to complete with retrieval operation is illustrated in FIG. 4 where it can be appreciated that the BLR 22 remains engaged with the wickers 14 and the tool interface 38 moves over the BLR 22 due to a clearance bore 39 having an inside diameter that is larger than an outside diameter of the BLR 22.

Figure 5:
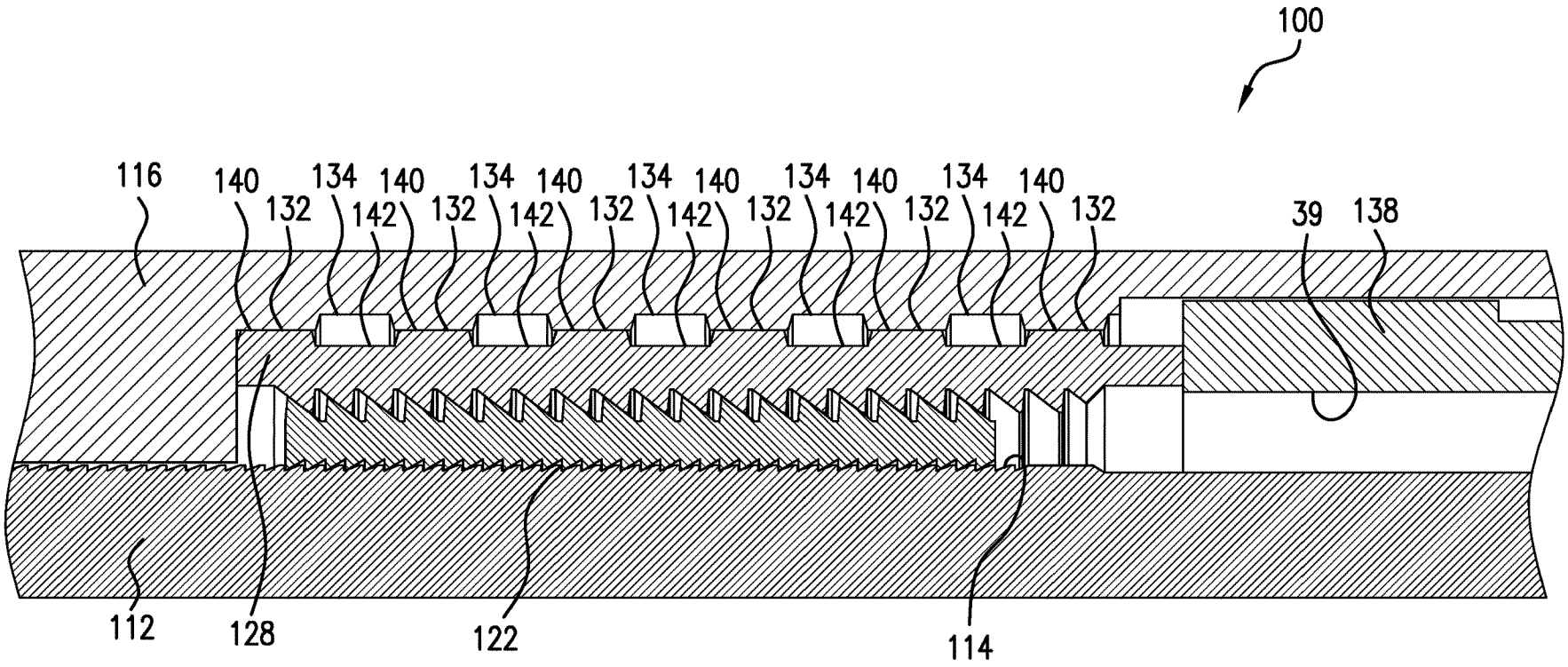
FIG. 5 is an alternate embodiment in a set position.
Figure 6:
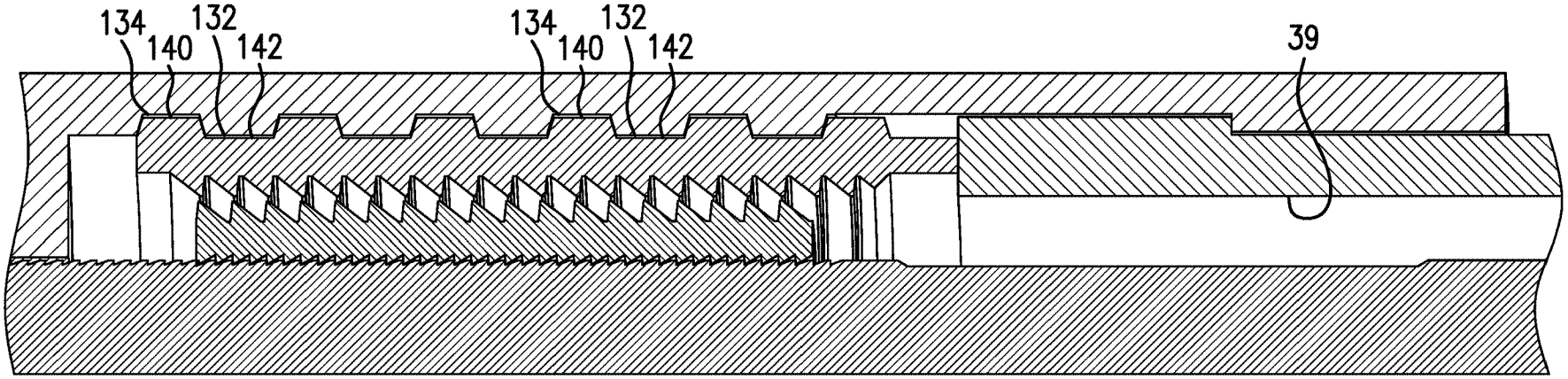
FIG. 6 is the alternate embodiment of FIG. 5 in the release position.

In an alternate embodiment, illustrated in FIGS. 5 and 6, like parts have been numbered with 100 series equivalent numerals for clarity. In this embodiment, the required stroke of the mechanism 110 is reduced by replacing the two independent regions 32 and 34 with longitudinally shorter and interspersed regions 132 and 134. In other aspects this embodiment is the same as the forgoing embodiment. Viewing FIGS. 5 and 6 together will provide the understanding. When the mechanism is in the set position of FIG. 5, the regions 132 interact with merlons 140 and when it is in the retrieve position the regions 132 interact with the crenels 142. This embodiment significantly reduces the required stroke to unsupport the engager/engagement member 128 and allow retrieval of the downhole tool. In other respects, the teachings associated with the embodiment of FIGS. 1-4 apply to the embodiment of FIGS. 5-6.

If a threshold tensile load is desired prior to retrieval, a releaser/release member 48 such as a shear screw may be placed anywhere the sleeve 16 and the tool interface 38 overlap. One location is shown in FIG. 1 with an illustration of a shear screw.

Figure 7:
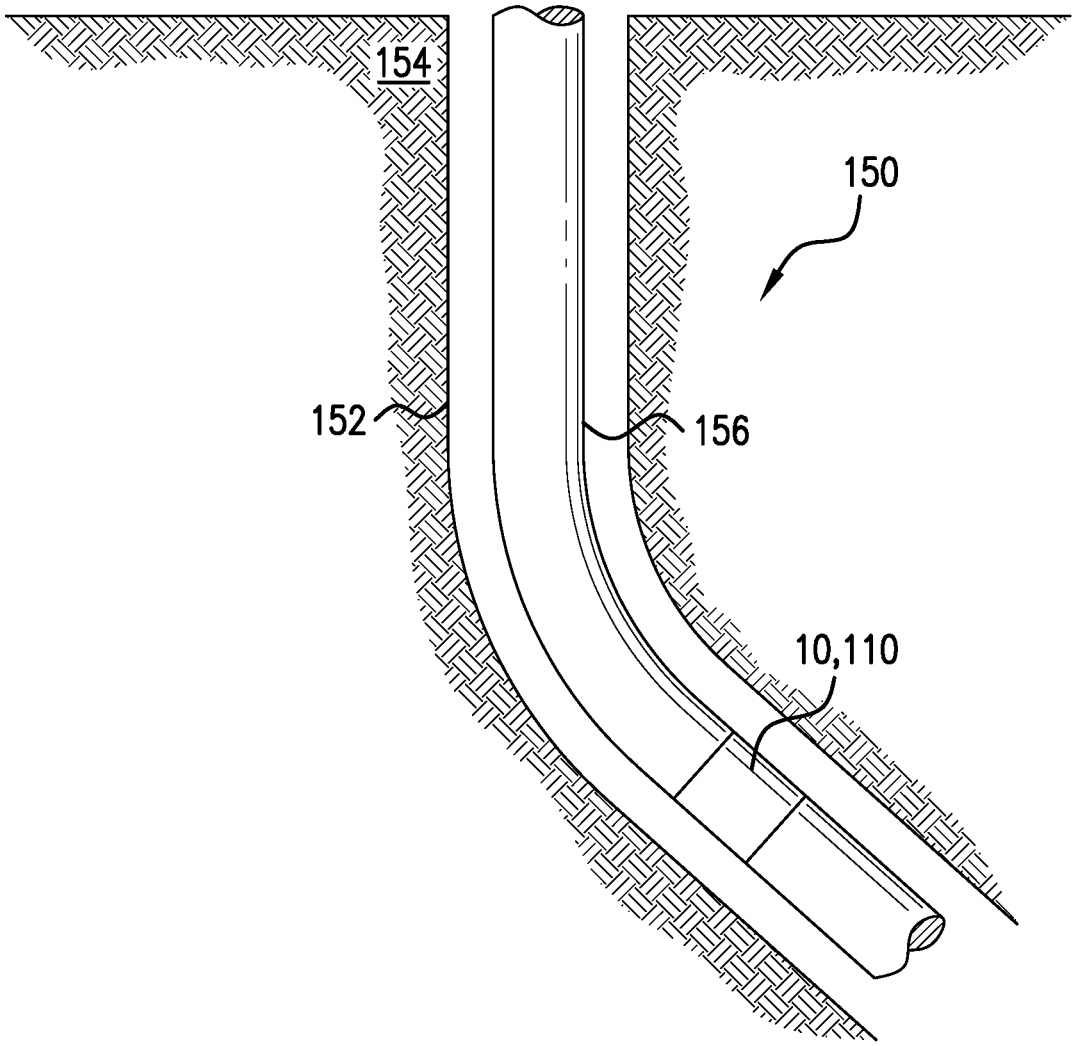
FIG. 7 is a well system including a tool with the release mechanism therein.

Finally, a well system 150 is schematically illustrated in FIG. 7. The system 150 comprises a borehole 152 in a subsurface formation 154. A string 156 is disposed in the borehole and a retrieval mechanism 10, 110 is disposed with the string 156.

Set forth below are some embodiments of the foregoing disclosure:

Embodiment 1: A setting and retrieval mechanism for a well tool including a mandrel, a body lock ring disposed on the mandrel, a body lock ring engager/engagement member engaged and disengagable with the body lock ring, and a setting load and retrieval sleeve disposed on the mandrel and having an engager/engagement member support region and an engager/engagement member release region.

Embodiment 2: The setting and retrieval mechanism as in any prior embodiment further including a retrieval hook on the setting load and retrieval sleeve.

Embodiment 3: The setting and retrieval mechanism as in any prior embodiment, wherein the body lock ring includes inside surface wickers in one way ratchetable engagement with outside surface wickers of the mandrel.

Embodiment 4: The setting and retrieval mechanism as in any prior embodiment, wherein the body lock ring incudes outside surface wickers being ratchetable in a same direction as one way ratcheable wickers on an inside surface of the body lock ring.

Embodiment 5: The setting and retrieval mechanism as in any prior embodiment, wherein the body lock ring outside surface wickers include a flank having an angle of 60 degrees or less measured from a longitudinal axis of the body lock ring.

Embodiment 6: The setting and retrieval mechanism as in any prior embodiment, wherein the engager/engagement member includes wickers ratchetable in a retrieval direction.

Embodiment 7: The setting and retrieval mechanism as in any prior embodiment, wherein setting load passes through a shoulder of the setting load and retrieval sleeve in contact with the engagement member and from the engager/engagement member in contact with a setting sleeve.

Embodiment 8: The setting and retrieval mechanism as in any prior embodiment, wherein the engager/engagement member release region provides sufficient radial space to allow disengagement of the engager/engagement member from the body lock ring.

Embodiment 9: The setting and retrieval mechanism as in any prior embodiment, wherein radial movement of the engager/engagement member into the radial space is facilitated by an angle of wickers engaging the engager/engagement member to the body lock ring.

Embodiment 10: The setting and retrieval mechanism as in any prior embodiment, wherein the angle is 60 degrees or less measured from a longitudinal axis of the engager/engagement member.

Embodiment 11: The setting and retrieval mechanism as in any prior embodiment, wherein the support region and the release region are each a collection of regions and are configured as a castellation.

Embodiment 12: The setting and retrieval mechanism as in any prior embodiment, wherein the engager/engagement member exhibits a complementary castellation.

Embodiment 13: The setting and retrieval mechanism as in any prior embodiment, further including a releaser/release member restricting movement of the setting and retrieval sleeve.

Embodiment 14: The setting and retrieval mechanism as in any prior embodiment, wherein the releaser/release member is a shear screw.

Embodiment 15: A method for retrieving a downhole tool including moving a setting and retrieval sleeve to position an engager/engagement member release region of the setting and retrieval tool to allow disengagement of an engager/engagement member with a body lock ring, placing a tensile force on the setting and retrieval sleeve, disengaging the engagement sleeve from the body lock ring under the impetus of the tensile force on the setting and retrieval sleeve, and releasing captured energy in the downhole tool by the disengaging and the tensile force on the setting and retrieval sleeve.

Embodiment 16: The method as in any prior embodiment, wherein the moving of the setting and retrieval sleeve is pulling from an uphole location.

Embodiment 17: The method as in any prior embodiment, wherein the disengaging includes driving the engager/engagement member away from the body lock ring with wickers.

Embodiment 18: A well system including a borehole in a subsurface formation, a string in the borehole, and a setting and retrieval mechanism as in any prior embodiment, disposed with the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A setting and retrieval mechanism for a well tool comprising:

a mandrel;

a body lock ring disposed on the mandrel;

a body lock ring engager engaged and disengagable with the body lock ring;

a setting load and retrieval sleeve disposed on the mandrel and having an engager support region and an engager release region; and a tool interface movably engaged with the setting and retrieval sleeve, the tool interface including a clearance bore therein having an inside diameter larger than an outside diameter of the body lock ring.

2. The setting and retrieval mechanism as claimed in claim 1 further including a retrieval hook on the setting load and retrieval sleeve.

3. The setting and retrieval mechanism as claimed in claim 1 wherein the body lock ring includes inside surface wickers in one way ratchetable engagement with outside surface wickers of the mandrel.

4. The setting and retrieval mechanism as claimed in claim 1 wherein the body lock ring incudes outside surface wickers being ratchetable in a same direction as one way ratchetable wickers on an inside surface of the body lock ring.

5. The setting and retrieval mechanism as claimed in claim 4 wherein the body lock ring outside surface wickers include a flank having an angle of 60 degrees or less measured from a longitudinal axis of the body lock ring.

6. The setting and retrieval mechanism as claimed in claim 1 wherein the engager includes wickers ratchetable in a retrieval direction.

7. The setting and retrieval mechanism as claimed in claim 1 wherein setting load passes through a shoulder of the setting load and retrieval sleeve in contact with the engager and from the engager in contact with a setting sleeve.

8. The setting and retrieval mechanism as claimed in claim 1 wherein the engager release region provides sufficient radial space to allow disengagement of the engager from the body lock ring.

9. The setting and retrieval mechanism as claimed in claim 8 wherein radial movement of the engager into the radial space is facilitated by an angle of wickers engaging the engager to the body lock ring.

10. The setting and retrieval mechanism as claimed in claim 9 wherein the angle is 60 degrees or less measured from a longitudinal axis of the engager.

11. The setting and retrieval mechanism as claimed in claim 1 wherein the support region and the release region are each a collection of regions and are configured as a castellation.

12. The setting and retrieval mechanism as claimed in claim 11 wherein the engager exhibits a complementary castellation.

13. The setting and retrieval mechanism as claimed in claim 1 further including a releaser restricting movement of the setting and retrieval sleeve.

14. The setting and retrieval mechanism as claimed in claim 13 wherein the releaser is a shear screw.

15. A method for retrieving a downhole tool comprising:

moving a setting and retrieval sleeve to position an engager release region of the setting and retrieval sleeve to allow disengagement of an engager with a body lock ring, the body lock ring, until disengagement, holding captured energy in the downhole tool;

placing a tensile force on the setting and retrieval sleeve;

disengaging the engager from the body lock ring under the impetus of the tensile force on the setting and retrieval sleeve; and releasing the captured energy in the downhole tool by the disengaging and the tensile force on the setting and retrieval sleeve, including moving a tool interface having a clearance bore therein, the bore having an inside diameter larger than an outside diameter of the body lock ring.

16. The method as claimed in claim 15 wherein the moving of the setting and retrieval sleeve is pulling from an uphole location.

17. The method as claimed in claim 15 wherein the disengaging includes driving the engager away from the body lock ring with wickers.

18. A well system comprising:

a borehole in a subsurface formation;

a string in the borehole; and a setting and retrieval mechanism as claimed in claim 1 disposed with the string.

19. A setting and retrieval mechanism for a well tool comprising:

a mandrel;

a body lock ring disposed on the mandrel;

a body lock ring engager engaged and disengagable with the body lock ring; and a setting load and retrieval sleeve disposed on the mandrel and having an engager support region and an engager release region, the setting load and retrieval sleeve including a retrieval hook.

* * * * *